US006729473B2

(12) United States Patent
Anderson

(10) Patent No.: US 6,729,473 B2
(45) Date of Patent: May 4, 2004

(54) AIR-EVACUABLE BAG WITH DOUBLE-LAYERED VALVE FILM AND METHOD FOR MANUFACTURING SAME

(75) Inventor: Brent Anderson, Barrington, IL (US)

(73) Assignee: CTI Industries Corporation, Barrington, IL (US)

( * ) Notice: Subject to any disclaimer, the term of this patent is extended or adjusted under 35 U.S.C. 154(b) by 73 days.

(21) Appl. No.: 10/176,287

(22) Filed: Jun. 20, 2002

(65) Prior Publication Data

US 2003/0234202 A1 Dec. 25, 2003

(51) Int. Cl.[7] ..... B65D 81/20
(52) U.S. Cl. ..... 206/524.8; 383/100; 493/213
(58) Field of Search ..... 206/522, 524.8; 383/44, 100, 103; 493/186, 210, 212, 213

(56) References Cited

U.S. PATENT DOCUMENTS

| | | | | |
|---|---|---|---|---|
| 2,595,708 A | * | 5/1952 | Salfisberg | 383/100 |
| 2,696,342 A | | 12/1954 | Toborg | |
| 2,778,173 A | | 1/1957 | Taunton | |
| 3,430,842 A | | 3/1969 | Yamaguchi | |
| 3,516,217 A | | 6/1970 | Gildersleeve | |
| 4,524,460 A | | 6/1985 | Twiehoff et al. | |
| 4,834,554 A | * | 5/1989 | Stetler et al. | 383/100 |
| 4,890,744 A | * | 1/1990 | Lane et al. | 383/100 |
| 4,917,646 A | | 4/1990 | Kieves | |
| 5,240,112 A | | 8/1993 | Newburger | |
| 5,405,479 A | | 4/1995 | Anderson | |
| 5,480,030 A | | 1/1996 | Sweeney et al. | |
| 5,540,500 A | | 7/1996 | Tanaka | |
| 5,558,441 A | | 9/1996 | Morrison et al. | |
| 5,701,996 A | | 12/1997 | Goto et al. | |
| 5,839,582 A | | 11/1998 | Strong et al. | |
| 5,881,881 A | | 3/1999 | Carrington | |
| 5,894,929 A | * | 4/1999 | Kai et al. | 206/524.8 |
| 5,931,189 A | | 8/1999 | Sweeney et al. | |
| 5,973,768 A | | 10/1999 | Mazion et al. | |
| 6,029,810 A | | 2/2000 | Chen | |
| 6,039,182 A | | 3/2000 | Light | |
| 6,059,457 A | | 5/2000 | Sprehe et al. | |
| 6,116,781 A | | 9/2000 | Skeens | |
| 6,135,253 A | | 10/2000 | Weissman et al. | |
| 6,202,849 B1 | | 3/2001 | Graham | |
| 6,227,706 B1 | | 5/2001 | Tran | |
| 6,231,236 B1 | | 5/2001 | Tilman | |
| 6,357,915 B2 | * | 3/2002 | Anderson | 383/100 |
| 2002/0009240 A1 | | 1/2002 | Anderson | |

FOREIGN PATENT DOCUMENTS

| | | |
|---|---|---|
| FR | 1436422 | 3/1966 |
| FR | 2810640 | 12/2001 |
| GB | 944425 | 12/1963 |
| JP | 05338657 | 12/1993 |
| JP | 07156964 | 6/1995 |

* cited by examiner

*Primary Examiner*—Luan K. Bui
(74) *Attorney, Agent, or Firm*—Marshall Gerstein & Borun LLP

(57) ABSTRACT

An air-evacuable bag has a one-way valve therein having two layers of valve film, neither of which is the sidewall of the bag. By forming the one-way valve of smooth, double-layered valve film, unwanted air gaps caused by textured surfaces in the sidewalls of the bag are avoided, thereby minimizing air leakage back into an evacuated bag. A method for the manufacture of such air-evacuable bags incorporates a roll supplying a first valve film layer, a roll supplying a first sidewall layer, a roll supplying a second valve film layer, and a roll supplying a second sidewall layer. As the film coming off the first valve film layer roll passes the roll supplying the first sidewall layer, both the sidewall layer and first valve film layer move in close proximity to one another until the valve film is tacked to the first sidewall layer. The second film and second sidewall layer are processed simultaneously in a like manner, and all four layers are joined at a sealing station.

12 Claims, 3 Drawing Sheets

AIR-EVACUABLE BAG WITH DOUBLE-LAYERED VALVE FILM AND METHOD FOR MANUFACTURING SAME

BACKGROUND

1. Field of the Invention

This invention relates generally to air-evacuable travel bags and, more particularly, to improving the air impermeability of the one-way valve used to evacuate air from such bags.

2. Description of the Prior Art

It has been known to manufacture air-evacuable travel bags wherein a portion of the sidewalls thereof are heat sealed to one another to form one or more air-evacuation channels within the bag, typically along an edge thereof. The general object of such channels is to form a valve in the bag through which unwanted air is expelled from the bag when the sidewalls of the bag are pressed toward one another. The valve is preferably of sufficient length that ambient air pressure keeps the sealed sidewalls of the bag over the length of the valve together, which is intended to prevent air from re-entering the bag.

Unfortunately, the materials used in manufacture of the film forming the sidewalls of the bag, at least at a microscopic level, are of sufficient texture to prevent smooth wall-to-wall contact over the length of the valve under normal ambient air pressure conditions. As a result, over time, unwanted air tends to seep back into the bag. It would be desirable if an air-evacuable travel bag were provided with a valve that was resistant to such tendencies.

DETAILED DESCRIPTION OF A PREFERRED EMBODIMENT

Figure 1:
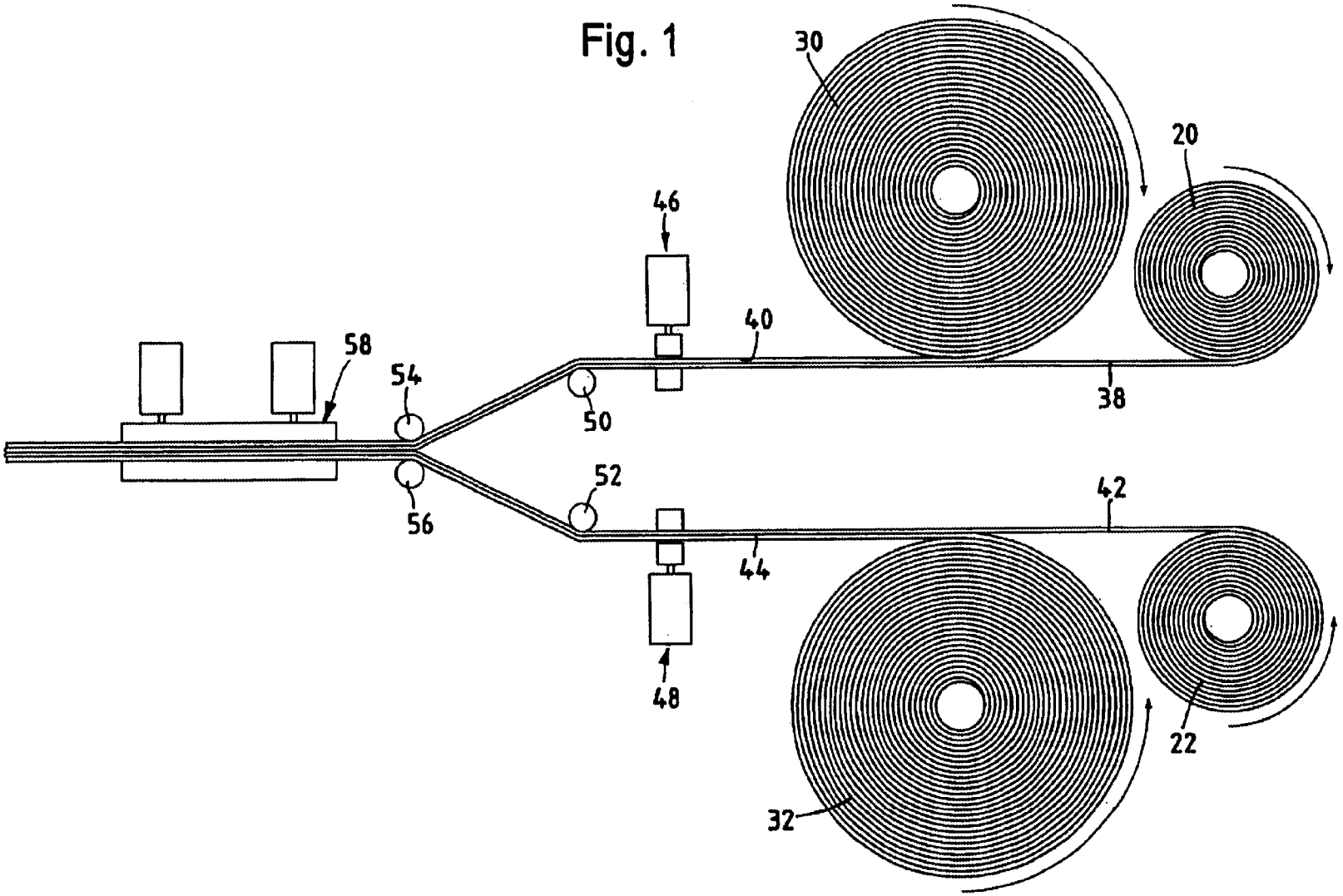
FIG. 1 is a schematic view of a manufacturing line for producing air-evacuable bags including a double-layered valve therein.
Figure 2:
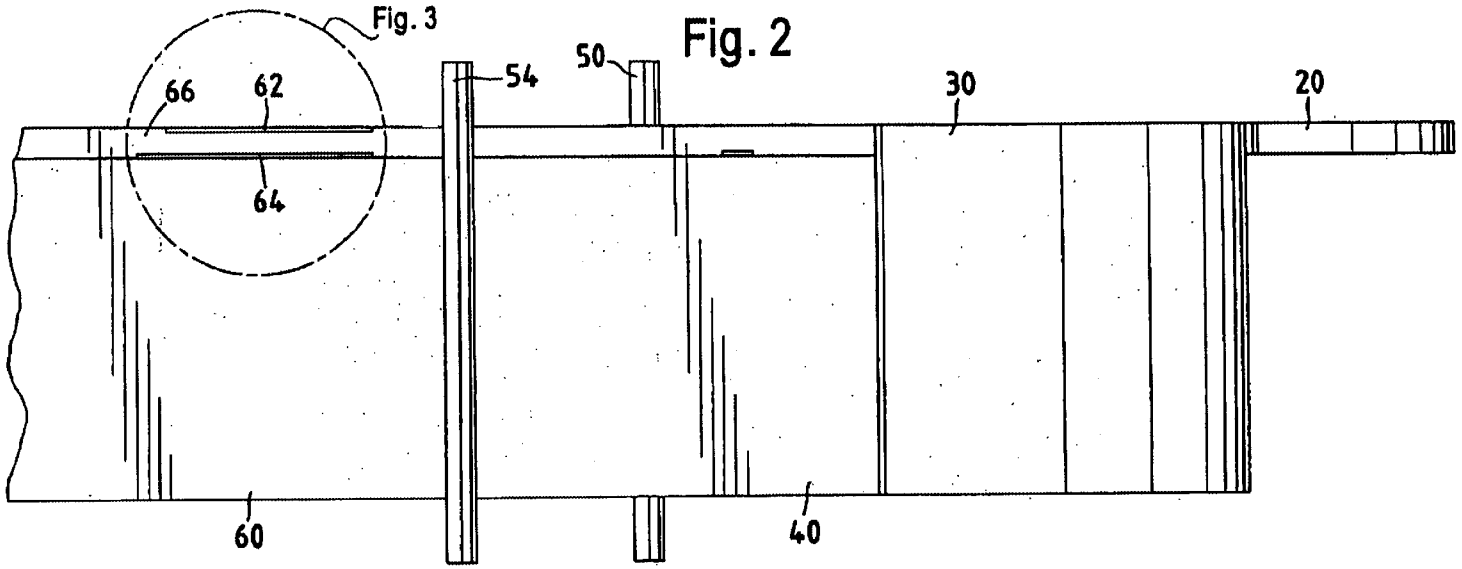
FIG. 2 is a top view of the manufacturing line shown in FIG. 1.
Figure 5:
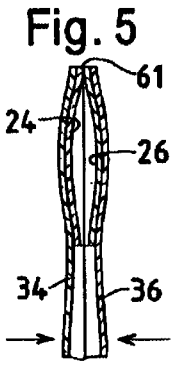
FIG. 5 is a cross-sectional view, similar to FIG. 4, but showing the valve portion of the air-evacuable bag partially filled with air.

A preferred method of manufacturing air-evacuable bags, such as travel bags, having a double-layered valve therein is shown schematically in FIGS. 1 and 2. From right to left, there is a first valve film roll 20 and a second valve film roll 22, used to form a first layer 24 and second layer 26 (see FIGS. 4, 5 and 6) of the valve, respectively. Next to the first and second valve film rolls 20, 22, there are separate first and second bag film rolls 30, 32, which provide the first sidewall 34 and second sidewall 36, respectively, of the air-evacuable bag.

The film coming off the first valve film roll 20 is referenced herein as the first valve film 38. The film coming off the first bag film roll 30 is referenced herein as the first sidewall film 40. Likewise, the film coming off the second valve film roll 22 is referenced herein as the second valve film 42, and the film coming off the second bag film roll 32 is referenced herein as the second bag film 44. As the first valve film 38 passes the first bag film roll 30, the first valve film 38 and the first sidewall film 40 travel simultaneously, preferably in immediate proximity to one another, to a first valve film tacking station at which a first tacking head 46 seals the first valve film 38 to the first sidewall film 40. Similarly, as the second valve film 42 passes the second bag film roll 32, the second valve film 42 and second sidewall film 44 travel simultaneously, preferably in immediate proximity to one another, to a second valve tacking station at which a second tacking head 48 seals the second valve film 42 to the second sidewall film 44.

Advantageously, the first and second valve films 38, 42 are smooth compared to the relatively rough surface of the first and second sidewall films 40, 44. After the first valve film 38 is tacked to the first sidewall film 40, and the second valve film 42 is tacked to the second sidewall film 44, the two valve films 38, 42 are brought together by a plurality of rollers 50, 52, 54, 56, which also brings the first and second sidewall films 40, 44 into close proximity to one another. Because in an air-evacuable bag such as a travel bag, a zipper seal may be provided at an end 60 of the first and second sidewall films 40, 44 in a separate operation, and in a manner that is known in the art and beyond the scope of this disclosure, this end 60 is left unsealed. However, it is recognized that if it is desired to include a double-layered valve in a bag without such a zipper seal, a heat seal could be imparted across the end 60, whereby the first and second sidewall films 40, 44 would be sealed together at end 60.

A heat seal station includes a master seal bar 58, which imparts an elongated heat seal 61 along an end 62 of the first and second valve films 24, 26. The elongated heat seal 61 does not extend across the entire end 62, but intermittently leaves a gap 66. When the first and second sidewall films 40, 44 are heat sealed and severed in a direction transverse to the direction of travel, which forms side edges 68, 70 of individual bags, these transverse heat seals and cuts are preferably located such that the gap 66 is positioned at an extreme end of a bag, adjacent side edge 70. The master seal bar 58 is preferably shaped such that its heat sealing surface extends most, but not all, the way along the end 62.

The master seal bar 58 also imparts an elongated heat seal 64 in the direction of travel of the films 38, 40, 42, 44 to a portion of the films 38, 40, 42, 44 a short distance away from end 62, leaving an intermittent gap 72. When the first and second sidewall films 40, 44 are heat sealed and severed in a direction transverse to the direction of travel, which forms side edges 68, 70 of individual bags, these transverse heat seals and cuts are preferably located such that the gap 66 is positioned at an extreme end of a bag, adjacent side edge 68. The heat seals 61, 64 define an elongated channel 74 between the first valve film 38 and second valve film 42 through which air can travel. The elongated channel 74 is bounded not only by the first and second valve films 38, 42 and the elongated heat seals 61, 64, but also by the side edges 68, 70 formed by heat seals in the direction transverse to the direction of travel of the films. Advantageously, once the films 38, 40, 42, 44 are severed along their side edges 68, 70, forming a bag, pressure exerted on the sidewalls 34, 36 of the bag at a location away from the elongated channel 74 (represented by arrows in FIG. 5) results in air contained in the bag being pushed through the gap 72, along the elongated channel 74, and out the gap 66.

It is found that the valve tacks 46, 48 only need to seal the valve film layers 38, 42 to the respective sidewall films 40, 44 at the valve entry and exit gaps 66, 72, in order to avoid any air getting between the sidewall films 40, 44 and the adjacent valve film layers 38, 42. The master seal bar 58 advantageously seals through all four film layers along elongated heat seals 61 and 64, thereby preventing air getting between the sidewall films 40, 44 and the adjacent valve film layers 38, 42 along the rest of the length of the end 62 of the bag 10, while still leaving valve entry and exit gaps 66, 72 unsealed between the two valve film layers 38, 42 to selectively allow for the evacuation of air from the bag.

Figure 4:
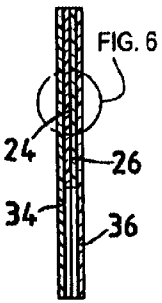
FIG. 4 is a cross-sectional view taken along lines 4—4 of FIG. 3.
Figure 3:
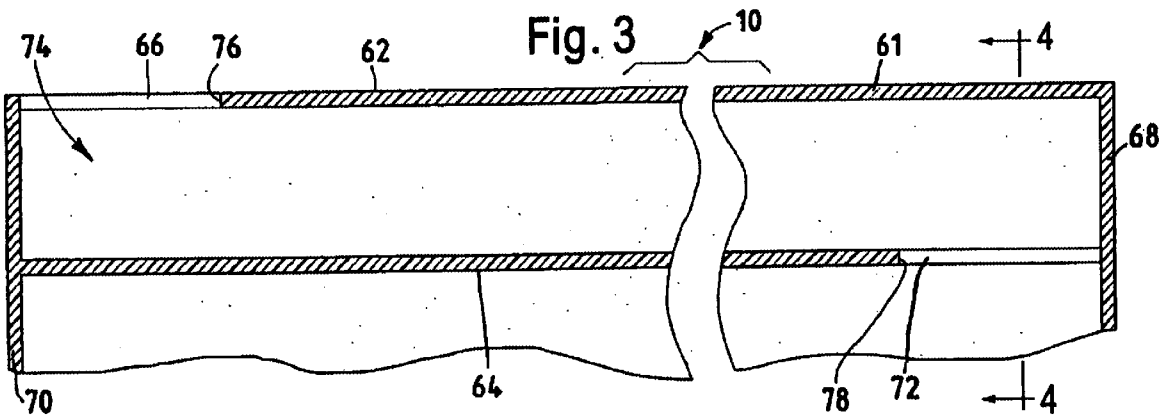
FIG. 3 is a cross-sectional view, partially broken away, taken along line 3 of FIG. 2, of the valve portion of one of the air-evacuable bags, after the bag has been severed in a direction transverse to the direction of travel of the films during manufacture.

Due to the length of the elongated channel 74 and the somewhat tortuous path therethrough air would need to take to re-enter the bag, when no pressure is exerted on the sidewalls 34, 36 atmospheric pressure is sufficient to keep the sidewalls 34, 36 pressed together on the outside of the elongated channel 74, which in turn presses the valve walls 24, 26 together, thereby sealing the valve, as shown in FIG. 4.

Figure 6:
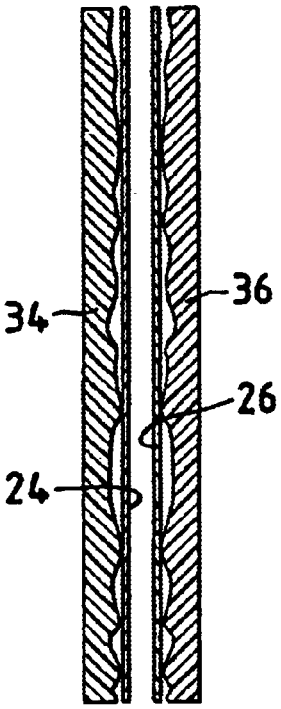
FIG. 6 is an enlarged cross-sectional view, taken along line 6 of FIG. 4.
Figure 7:
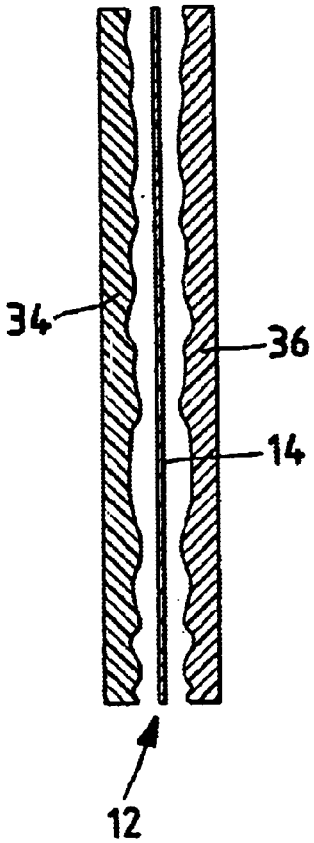
Fig. 7 PRIOR ART
FIG. 7 is an enlarged cross-sectional view of a valve in a prior art valve configuration for an air-evacuable bag.

The double-layered valve is particularly useful in bags made of rough or textured bag film. For example, it is not uncommon to use a netting material, known in the art as scrim, within bag film in order to give bag film extra tensile strength. Additionally, extrusion coatings on bag film can give the bag a rough texture. On a microscopic level, as shown in FIG. 7, this texture in the bag film can be problematic when using the bag film as one or both walls of a one-way valve, because over time, air undesirably leaks back into the bag. The double-layered valve, as shown in FIG. 6, advantageously allows the valve to have both its walls constructed of a smooth film. The double-layered valve construction ensures a more reliable one-way valve, despite the texture in the bag film, inasmuch as air will have difficulty negotiating smaller gaps, if any, between the relatively smooth valve film layers 24, 26.

One particular type of bag for which the double-layered valve is useful is a bag made of sidewalls of embossed film. For example, bags having embossments, i.e. embossed patterns, on at least the inner layer of the sidewall films have been known to provide channels to facilitate drainage of fluids down the sidewalls of the bags. Due to the inherent roughness that results from such embossing, which, for example, can be extrusion coated onto the sidewall film, the double-layered valve advantageously allows the valve to have both its walls constructed of a smooth film, as with other textured films, thereby assuring a more reliable one-way valve, despite the presence of embossments in the bag film.

In forming the valve layers, various materials may be employed. Such materials include, but are not limited to, low density polyethylene (LDPE), linear low density polyethylene (LLDPE) or poly/evoh/poly. Although more costly than other materials, poly/evoh/poly provides an added benefit, in that it is a barrier film. The valve layers preferably each has a thickness of 2 mil, for a combined thickness of 4 mil This thickness for the valve film layers is found to provide the valve layers with sufficient stiffness to avoid conforming entirely to the adjacent sidewall films, and yet allow the valve film layers to conform to some extent to one another, such that the valve film layers sealingly close in the absence of pressure on the sidewalls of the bag.

The bag containing the double-layered valve film is best shown in FIGS. 3–6. The bag, generally designated by reference number 10, has a first sidewall 34 and a second sidewall 36, joined together at heat sealed edges 68, 70. Along one end 62 of the bag 10, which may, but need not necessarily, be a lower end of the bag 10, a first valve film layer 24 is disposed adjacent the first sidewall 34, and a second valve film layer 26 is disposed adjacent the second sidewall 36. An elongated heat seal 61 extends along the end 62 of the bag 10, which connects the valve film layers 24, 26 to one another along the end 62. Another heat seal 64 is provided parallel to the elongated heat seal 61, and spaced some distance, for example, in a range of 25 to 45 mm, from the elongated heat seal 61, defining an elongated channel 74. A gap 66, also referred to herein as a valve exit gap, is provided, preferably at one end 76 of the elongated heat seal 61, where the valve film layers 24, 26 are not sealed to one another, which provides an opening through which unwanted air can be expelled from the elongated channel 74. A gap 72 is provided, preferably at an end 78 of the elongated heat seal 64 which is opposite to the end 76 of the elongated heat seal 61. The gap 72, also referred to herein as a valve entry gap, permits unwanted air from the interior of the bag 10, referred to as the main chamber of the bag, to enter the elongated channel 74 when pressure is exerted on the sidewalls 34, 36 of the bag, as indicated by the directional arrows in FIG. 5.

As a result, the air being evacuated from the bag 10 travels between the two valve film layers 24, 26, but not between the sidewalls 34, 36 and the respective valve film layers 24, 26. Since the valve film layers are smooth, regardless of any texture imparted to the sidewalls 34, 36, a more reliable seal of the valve is obtained, so that the valve can truly be regarded as a one-way valve. In other words, when no pressure is physically exerted on the sidewalls 34, 36, ambient atmospheric pressure is sufficient to press the valve film layers 24, 26 toward one another, effectively closing valve entry and valve exit gaps 66 and 72, thereby impeding unwanted air from entering the elongated valve channel 74 and the bag 10. By contrast, in prior art valve channels 12 for air-evacuable bags, as shown in FIG. 7, where at most one valve film layer 14 was provided, the texture of the sidewalls 34, 36, due to the presence of, for example, a netting material, known in the art as scrim, within bag sidewall film in order to give bag sidewall film extra tensile strength, or extrusion coatings on the bag sidewall film, can create gaps sufficient to allow unwanted air to enter the valve and enter the main chamber of the bag.

While the present invention has been described with respect to certain embodiments thereof, it is not intended to be limited thereto. Those of ordinary skill in the art will appreciate that modifications to the disclosed embodiments can be made which are still in the scope of the appended claims.

What is claimed is:

1. A method for manufacturing an evacuable bag comprising:

providing a first valve film layer;

providing a second valve film layer;

providing a first sidewall film;

providing a second sidewall film;

tacking the first valve film layer to the first sidewall film;

tacking the second valve film layer to the second sidewall film;

forming a first elongated seal between the first and second valve film layers;

forming a second elongated seal between the first and second valve film layers, said second elongated seal being substantially parallel to the first elongated seal and spaced apart from said first elongated seal, creating an elongated channel between the first and second elongated seals;

leaving a valve exit gap in the forming of the first elongated seal between the first and second valve film layers, at one end of the elongated channel;

leaving a valve entry gap in the forming of the second elongated seal between the first and second valve film layers, at an end of the elongated channel opposite the valve exit gap; and and sealing and severing the first and second sidewall films in a direction perpendicular to the first and second elongated seals to form sides of the evacuable bag.

2. The method of claim 1, wherein said first valve film layer is provided from a wound first valve film roll.

3. The method of claim 2, wherein said first sidewall film is provided by a first sidewall film roll, and as the first valve film layer passes said first sidewall film roll, the first valve film layer moves substantially parallel to the first sidewall film and the first valve film layer and first sidewall film move at a rate substantially equal to one another toward a first valve tacking station.

4. The method of claim 1, wherein said second valve film layer is provided by a second valve film layer roll.

5. The method of claim 1, wherein said second sidewall film is provided by a second sidewall film roll, and as the second valve film layer passes said second sidewall film roll, the second valve film layer moves substantially parallel to the second sidewall film and the second valve film layer and second sidewall film move at a rate substantially equal to one another toward a second valve tacking station.

6. The method of claim 1, wherein, prior to forming the first elongated seal between the first and second valve film layers, the first valve film layer and the first sidewall film are guided together with the second valve film layer and second sidewall film, and with an exposed surface of the first valve film layer facing an exposed surface of the second valve film layer.

7. An air-evacuable bag comprising:

a main compartment defined by a first sidewall and a second sidewall;

a first valve film in sealed engagement with a portion of said first sidewall;

a second valve film in sealed engagement with a portion of said second sidewall;

an elongated channel substantially segregated from the main compartment, the elongated channel defined by a first elongated seal sealing said first and second valve films to one another along an end of the evacuable bag;

a second elongated seal sealing said first and second valve films to one another, the second elongated seal being substantially parallel to and spaced apart from the first elongated seal;

a valve exit gap along the first elongated seal at one end of the elongated channel; and a valve entry gap along the second elongated seal at an end of the elongated channel opposite said end at which the valve exit gap is located.

8. The air-evacuable bag of claim 7, wherein said first sidewall is textured.

9. The air-evacuable bag of claim 7, wherein said second sidewall is textured.

10. The air-evacuable bag of claim 7, wherein said first and second valve films are substantially smooth relative to the respective first and second sidewalls.

11. The air-evacuable bag of claim 8, wherein the texture of the first sidewall includes embossed pattern on an inside surface of the first sidewall facing the second sidewall.

12. The air-evacuable bag of claim 9, wherein the texture of the second sidewall includes embossed pattern on an inside surface of the second sidewall facing the first sidewall.

* * * * *